United States Patent [19]

Ligeti

[11] 4,254,782

[45] Mar. 10, 1981

[54] TOBACCO SMOKE FILTER

[76] Inventor: Enrique C. Ligeti, 7700 Gardella Dr., Dublin, Calif. 94566

[21] Appl. No.: 92,651

[22] Filed: Nov. 9, 1979

[51] Int. Cl.[3] ..... A24F 13/02; A24F 13/04; A24F 5/04

[52] U.S. Cl. ..... 131/187; 131/198 A; 131/210; 131/261 B; 131/263

[58] Field of Search ..... 131/187, 198 R, 198 A, 131/210, 212 R, 212 A, 263

[56] References Cited

U.S. PATENT DOCUMENTS

| | | | |
|---|---|---|---|
| 3,116,746 | 1/1964 | Speck | 131/198 X |
| 3,270,751 | 9/1966 | Tucker | 131/198 |
| 3,810,476 | 5/1974 | Thomas | 131/187 |
| 3,926,199 | 12/1975 | Thomas | 131/187 |
| 4,158,364 | 6/1979 | Ligeti | 131/187 |

*Primary Examiner*—Stephen C. Pellegrino
*Attorney, Agent, or Firm*—Robert Charles Hill

[57] ABSTRACT

An improved tobacco smoke filter is provided with a novel arrangement of restricted passageways and expansion chambers which entrains the smoke so that greater diffusion thereof occurs in a first expansion chamber and greater and more efficient mixing with the ambient air occurs in a second expansion chamber than was previously possible in prior art devices, so that more tar and nicotine are removed and greater cooling of the smoke is provided. Indexing and indicating means are provided on the device so that the operator thereof may easily select the amount of ambient air desired for admission into the second expansion chamber.

3 Claims, 9 Drawing Figures

FIGURE 1
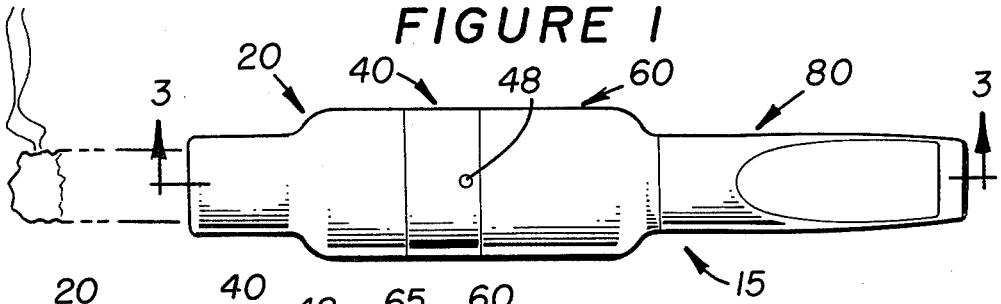
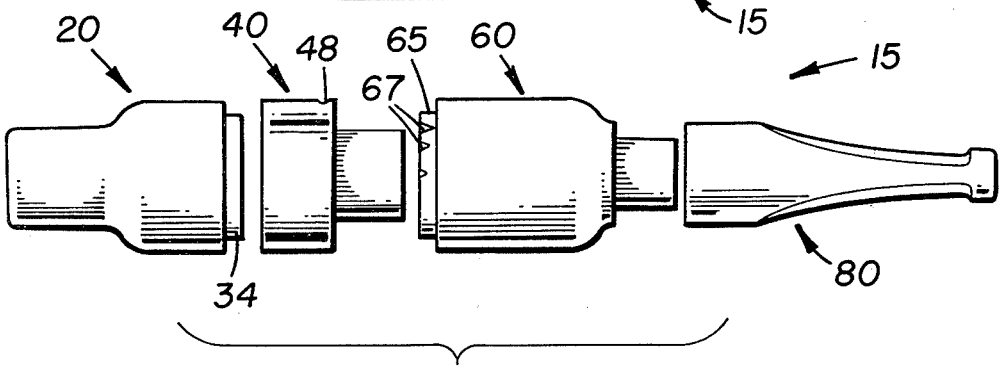
FIGURE 2
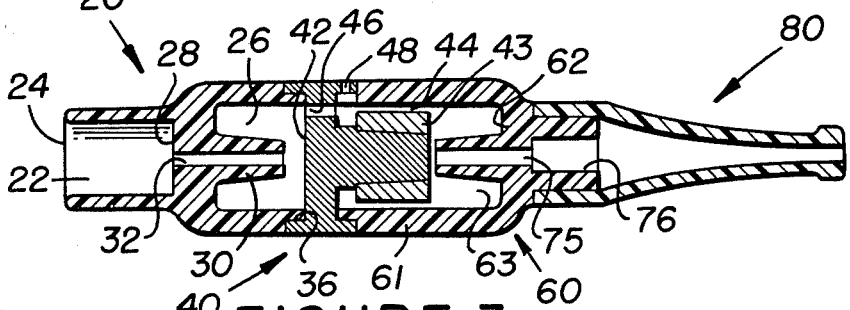
FIGURE 3
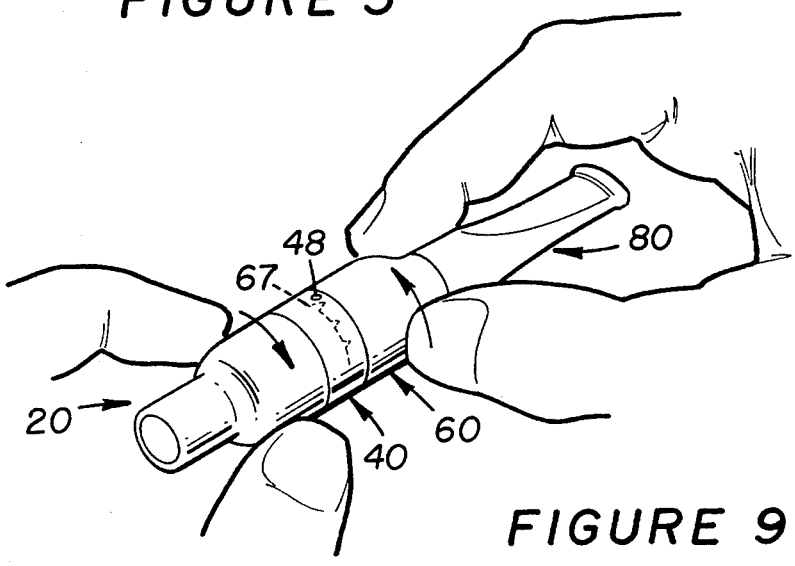
FIGURE 9

TOBACCO SMOKE FILTER

BACKGROUND OF THE INVENTION

An improved tobacco smoke filter for use with cigarettes has a plurality of expansion chambers and ambient air inlets for greater cooling of the smoke and increased nicotine and tar removal.

SUMMARY OF THE INVENTION

This invention relates to a tobacco smoke filter. More specifically, the invention relates to an improvement over the tobacco smoke filter shown in my U.S. Pat. No. 4,158,364.

The invention of my previous U.S. Pat. No. 4,158,364 has gained excellent market acceptance and is considered by independent testing laboratories to be one of the better devices of its kind on the market today.

However, I have made certain novel structural improvements to my previous invention which have resulted in an even superior tobacco smoke filter. These novel and useful changes of the present invention will be described in greater detail in the description set out below.

Briefly described, the improvements of the present invention comprise certain novel structural changes and arrangements of the restricted passageways and expansion chambers of the device which results in greater diffusion of the entrained smoke in the first expansion chamber. Furthermore, certain novel structural changes in the restricted passageway leading to the second expansion chamber of the device have resulted in a greater and more efficient mixing of the entrained smoke with the ambient air within the second expansion chamber over that which was previously possible through use of my above-mentioned prior art patent and all other prior art devices. The end result of these novel and beneficial structural changes is that more tar and nicotine are removed from the smoke stream and greater cooling of the smoke screen is provided.

It is the primary object of the present invention to provide a new and improved tobacco smoke filter.

Another object of the invention is to provide structure of the character described which is economical to produce and long lasting in usage.

The above-mentioned and other objects of the invention, together with the advantages gained from the novel features thereof, will appear from the following description of the preferred embodiments of the invention which are illustrated in the accompanying drawings which exemplify the best mode of construction and manner of utilizing the invention.

BRIEF DESCRIPTION OF THE DRAWINGS

Referring to the drawings:

FIG. 1 is a front elevational view of the preferred embodiment of the invention;

FIG. 2 is an exploded view of the device of FIG. 1, illustrating the various sections thereof in the order of their interconnections to one another;

FIG. 3 is a longitudinal sectional elevational view of the present embodiment of FIG. 1 and taken on the line 3—3 thereof;

FIG. 9 is a perspective view of the assembly with arrows to show relative movement of certain sections for adjusting the path of movement of inhaled smoke.

BRIEF DESCRIPTION OF THE PREFERRED EMBODIMENTS

Figure 5:
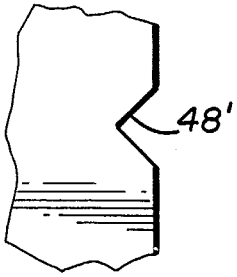
FIGS. 4, 5, 6, 7 and 8 are detailed sectional views illustrating certain features and modifications of the invention.
Figure 6:
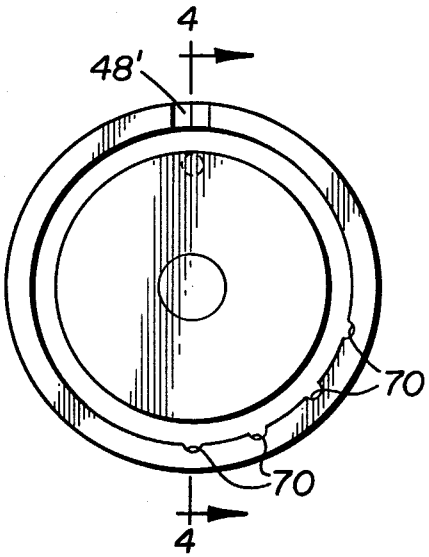

Referring now to FIG. 1 in conjunction with FIG. 2, the tobacco smoke filter of the present invention is generally shown at 15. The filter device 15 comprises an assembly of four major elements or sections. These major sections are: a cigarette receiving and holding section 20, a heat dissipating section 40, an air mixing section 60, and a mouthpiece section 80.

The sections are combined in a novel manner in order to produce a series of alternating restricted passageways and expansion chambers. In this manner, the cigarette smoke is compressed, expanded and cooled as it passes through the device with the beneficial result that the tars are trapped in the chambers and the nicotine is condensed by its own viscosity between the walls of the restricted passageways.

The sections may be fabricated or molded from any desired material. In the present embodiment, the sections 20, 60 and 80 are fashioned from an acrylic plastic material but any other suitable plastic may be employed such as a urea or a phenol condensate, which is extruded into a suitable mold for each of these plastic sections. Section 40 is fabricated from a heat dissipating metal, such as aluminum or an aluminum alloy; and can be made in connectible parts or preferably is cast as an integral unit for the sake of economy.

Referring now to FIG. 2 in conjunction with FIG. 3, the cigarette receiving and holding section 20 will now be explained in further detail. The section 20 comprises a hollow cavity 22 which has a first end 24 open to receive a cigarette (as shown in dotted outline in FIG. 1). Section 20 also comprises a first expansion chamber 26 located downstream of said hollow cavity 22. A first wall member 28 defines the second end of the cavity 22 and separates the cavity 22 from the first expansion chamber 26. A projection 30, of reduced diameter, extends longitudinally downstream from the wall 28 and extends throughout the chamber 26 as shown. A first restricted bore or passageway 32 extends through wall 28 and projection 30 for communicating a smoke stream from the cavity 22 to the chamber 26.

As best shown in FIG. 2 taken in conjunction with FIG. 3, the section 20 is provided with a reduced diameter annular shoulder 34. The shoulder 34 matingly fits into an annular flange 36 formed on the heat dissipating section 40. Preferably, these two sections are fixedly secured to each other.

The heat dissipating section 40 comprises a second wall means 42 which extends perpendicular to the bore 32 immediately downstream thereof so that smoke passed through the first bore is deflected by a first side of the second wall and is thereby circulated throughout the expansion chamber 26. This combination of features provides an important advantage over my prior art patent, referred to above, in three major respects. Firstly, locating the bore 32 on the longitudinal axis in the center of the device within the reduced diameter projection 30 provides a larger expansion chamber 26. Secondly, the external surface area of the projection 30 is much larger in area than the surface area provided in the prior art patent. Thirdly, the location of the bore 32 provides for greater surface area contact with the metal wall 42 of the heat dissipating section 40, which in turn leads to greater cooling of the smoke and a more complete diffusion of the smoke backwards into the chamber 26.

It should be noted that the heat dissipating section 40 is provided with a solid projection 43 extending longitudinally from a second side of the second wall 42. The solid projection 43 has an outer diameter which when combined with the inner diameter of the air mixing section 60 defines a narrow annular passageway 44 as shown. A second restricted bore or passageway 46 is located at a radially outward location on the wall 42 to communicate smoke from the chamber 26 through the bore 46 and into the annular restricted passage 44. As best shown in FIG. 2, the section 40 is also provided with an air inlet opening 48 which is located on an annular outer edge thereof at a location downstream of said second wall 42. The purpose of the air inlet opening 48 which can be selectively communicated with the restricted passageways 44 and 46 will be better understood at a later point in the description.

The air mixing section 60 is rotatably adjustable with respect to the heat dissipating section 40 and is removably connected thereto. Air mixing section 60 is formed with an annular outer wall 61 and a perpendicular wall section 62 located downstream of the projection 43 on heat dissipating section 40 to define a second expansion chamber 63.

As best shown in FIG. 2, the air mixing section 60 is provided with an annular inner shoulder 65 having a plurality of spaced apart passages 67 each of which has a different cross section. Thus, when the air mixing section 60 is rotated, a selected one of the passages 67 (FIG. 2) may be placed in communication with the air inlet opening 48 to conduct ambient air into the smoke stream in passageways 44 and 46 for mixing therewith in the second expansion chamber 63. This arrangement provides an important advantage over my prior art patent in that there is more effective mixing of the smoke screen with the ambient air before entering the second expansion chamber 63. In addition, the metal projection 43 of the heat dissipating section 40 combines with the inner surface of the annular outer wall 61 of the air mixing section to provide the restricted bore or passageway 44 to thereby increase the cooling and condensation of tars and nicotine.

Figure 4:
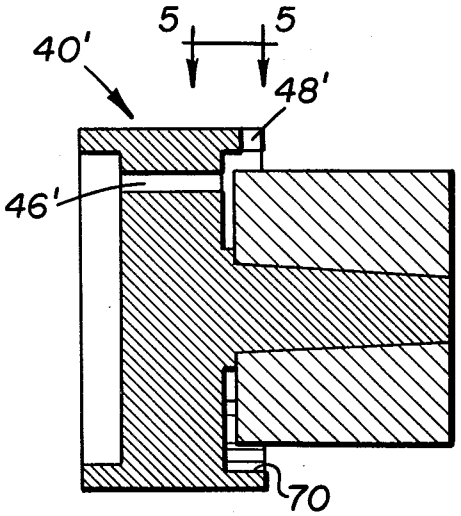
Figure 7:
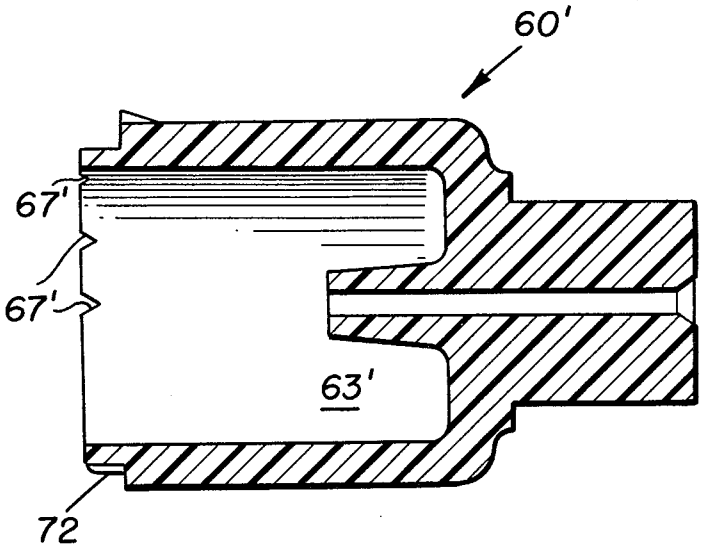
Figure 8:
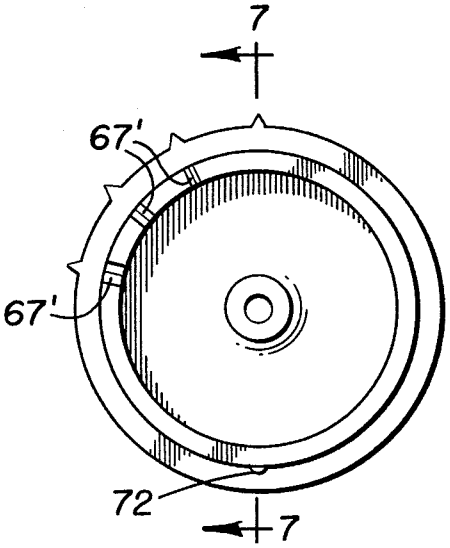

FIGS. 4–7 show certain modifications and other features of the invention. FIG. 4 illustrates that the passageways 67 (FIG. 7) take the form of grooves of varying cross section which combine with an air inlet groove 48' to admit selectively greater or smaller amounts of ambient air into the chamber 63 (FIG. 7).

FIGS. 4–8 also show an indexing means so that an operator of the device such as shown in FIG. 9 may easily adjust the selected passageway 67 or 67' with the air inlet opening 48 or 48'. The indexing means preferably takes the form of corresponding notches 70 (FIG. 6) and one protuberance 72 (FIG. 8) formed on the heat dissipating section 40 and air mixing section 60. In this manner an operator as shown in FIG. 9 may easily select the amount of ambient air desired to be admitted into the second chamber 63. In addition, marking means or other indicia are provided on the external surface of the device to indicate to the operator which of the varying sized openings 67 have been selectively operated by use of the indexing means.

Referring back to FIG. 3, it should be noted that a restricted passageway 75 in the wall 62 communicates the smoke screen from the chamber 63 to a chamber 76 formed in the downstream end of the air mixing section 60. The mouthpiece 80 is preferably fixedly secured to the air mixing section 60 as shown. The mouthpiece 80 is preferably of the same general construction as that described in my prior art patent previously referred to above.

It is to be understood that the appended claims are intended to cover not only the embodiments illustrated and described above, but also variations thereof which fall within the scope and purview of the invention.

I claim:

1. A tobacco smoke filter having a plurality of detachably connected sections comprising:

(a) a cigarette receiving and holding section, said receiving section having a hollow cavity with a first end of the cavity open to receive a cigarette, a first expansion chamber downstream of said hollow cavity, first wall means defining a second end of the cavity and separating said cavity from said first expansion chamber, a longitudinally extending reduced diameter projection extending from said first wall and into the first expansion chamber, a first restricted bore extending on the longitudinal axis of the filter through said first wall and throughout the reduced diameter projection for communicating said cavity with said first expansion chamber;

(b) a heat dissipating section connected to said cigarette receiving section, a second wall means associated with the heat dissipating section and extending perpendicularly to said first restricted bore immediately downstream thereof, so that smoke passed through the first restricted bore is deflected by a first side of said second wall and circulated throughout the first expansion chamber, a solid projection extending longitudinally from a second side of said second wall, a second restricted passage extending through said second wall at a radially outward location to communicate smoke from said first chamber with the outer surface of said solid projection of the second wall, an air inlet opening located on an annular outer edge of said heat dissipating section downstream of said second wall;

(c) a rotatably adjustable air mixing section removably connected to said heat dissipating section, said air mixing section having an annular outer wall having a larger inner diameter than the outer diameter of said second wall solid projection to define a second expansion chamber which has a third wall extending perpendicular to said second wall solid projection at a location downstream thereof, an annular inner shoulder formed on the extreme upstream end of said air mixing section, said annular inner shoulder having a series of spaced apart passages of different cross sections thereon, said passages adapted to be selectively placed in communication with said air inlet opening to conduct ambient air into the smoke stream for mixing therewith in said second expansion chamber, indexing means for positive engagement between said heat dissipating section and said air mixing section to selectively positively engage one of the spaced apart passages with the air inlet opening, and indicating means for indicating to the user of the filter device precisely which one of the varying sized spaced apart passages is in communication with the air inlet opening, said third wall having a centrally located restricted outlet bore extending longitudinally therethrough and into an enlarged diameter third expansion chamber formed in said third wall at the downstream end thereof; and (d) a mouthpiece section attached to the air mixing section downstream of the third expansion chamber.

2. A tobacco smoke filter as set forth in claim 1 wherein the heat dissipating section comprises a heat dissipating metal member.

3. A tobacco smoke filter as set forth in claim 2 wherein said indexing means comprises a series of matching notches and protuberances formed between the heat dissipating sections and the air mixing section, said notches and protuberances corresponding in number to the number of said spaced apart passages of varying cross section, and said indicating means comprising marking indicia on the outer surface of the device, so that an operator of the device may easily select the spaced apart passageway desired for varying the amount of ambient air admitted into the smoke stream entering said second chamber.

* * * * *